US005242714A

United States Patent [19]

Steele et al.

[11] Patent Number: 5,242,714

[45] Date of Patent: Sep. 7, 1993

[54] PROCESS FOR FORMING PROTECTIVE BASE COATINGS ON METALS

[75] Inventors: Duane C. Steele; William C. Strickland, both of Sterling Heights, Mich.

[73] Assignee: Henkel Corporation, Plymouth Meeting, Pa.

[21] Appl. No.: 810,998

[22] Filed: Dec. 20, 1991

[51] Int. Cl.[5] ..... B05D 3/10

[52] U.S. Cl. ..... 427/379; 427/383.7; 427/387; 427/388.1; 427/404; 148/250; 148/251; 148/253; 148/258; 106/14.12; 106/14.13; 106/14.15

[58] Field of Search ..... 427/379, 333, 383.7, 427/388.1, 387, 419.5, 404, 419.1; 148/250, 251, 253, 258; 106/14.12, 14.13, 14.15

[56] References Cited

U.S. PATENT DOCUMENTS

| | | | |
|---|---|---|---|
| 3,671,331 | 6/1972 | Malkin et al. | 148/6.2 |
| 3,706,603 | 12/1972 | Vessey et al. | 148/6.2 |
| 4,097,312 | 6/1978 | Dorsey, Jr. | 427/419.5 |
| 4,443,015 | 4/1984 | Duffer et al. | 277/30 |
| 4,457,790 | 7/1984 | Lindert et al. | 148/6.15 R |
| 4,515,919 | 5/1985 | Bradley et al. | 427/388.4 |
| 4,517,028 | 5/1985 | Lindert | 148/6.14 R |
| 4,546,015 | 10/1985 | Lovell | 427/247 |
| 4,647,316 | 3/1987 | Prescott | 148/6.16 |
| 4,963,596 | 10/1990 | Lindert et al. | 526/313 |
| 5,104,692 | 4/1992 | Belmares | 427/419.5 |

*Primary Examiner*—Anthony McFarlane

*Attorney, Agent, or Firm*—Ernest G. Szoke; Wayne C. Jaeschke; Norvell E. Wisdom, Jr.

[57] ABSTRACT

A process for forming a chromium/silica/phosphate protective conversion coating on a metal surface is improved by pretreating the surface with a composition comprising at least one of (i) $H_2TiF_6$, (ii) $H_2SiF_6$, and (iii) a derivative of poly{alkenylphenol} before applying the conversion coating. The process of the invention results in a protective base coating having superior adhesion to paint at a relatively high coating weight which is desirable for improved corrosion resistance. This process is especially useful in forming such protective conversion coatings on continuous cast aluminum surfaces.

20 Claims, No Drawings

PROCESS FOR FORMING PROTECTIVE BASE COATINGS ON METALS

BACKGROUND OF THE INVENTION

1. Field of the Invention

The invention relates to a process that produces improved adhesion of a relatively heavy protective conversion coating on a metal surface, with increased conversion coating weight, by applying to the surface a pretreatment composition comprising a derivative of poly(alkenylphenol} before applying the protective conversion coating. The process of the invention is especially useful in forming chromium and silica containing conversion coatings on aluminum surfaces, especially those that have been continuously cast.

2. Statement of Related Art

The need for applying protective conversion coatings to metal surfaces has long been recognized in the art. Important uses of such conversion coatings are to prevent corrosion and to serve as a base for subsequent painting of the metal surface. The corrosion quality of the painted article is determined by the level of adhesion of the paint to the protective conversion coating and/or the adhesion of the latter to the metal substrate, as well as by the resistance of the base coated and painted metal surface to humidity, salt-spray and similar tests. Where a forming operation is to be employed subsequent to painting, the protective conversion coating must provide a satisfactory level of paint adhesion during the forming step and of corrosion resistance of the metal in the environment in which it is to be used.

In the past, difficulties have often been encountered in developing a process for applying a protective conversion coating to metal surfaces and particularly to continuously cast aluminum surfaces. These difficulties result from the requirement that a protective base-coated product, after being painted, must exhibit satisfactory formability, adhesion, and corrosion characteristics and the fact that prior art methods generally require a compromise between the requirements of adhesion and corrosion resistance, particularly on continuously cast aluminum surfaces: Conversion coating weights greater than about 75 milligrams per square meter (hereinafter "mg/m$^2$"), are desirable on aluminum surfaces, and especially on continuous cast aluminum surfaces, to provide adequate corrosion resistance to the surfaces. For the best corrosion resistance, the conversion coating weights are preferably in the range from 86–130 mg/m$^2$, more preferably in the upper half of this range. However, it has been found necessary to keep the coating weight of the above-described hexavalent chromium protective conversion coating on continuously cast aluminum surfaces generally less than 75 mg/m$^2$, in order to obtain adequate adhesion of paint to the conversion coating.

U.S. Pat. Nos. 4,443,015, 4,457,790, 4,517,028, and 4,963,596 all describe the treatment of metal surfaces with dilute solutions of poly{alkenylphenol} derivatives and more specifically of a poly{4-vinylphenol} derivative or an acid salt of a poly{4-vinylphenol} derivative. These treatment solutions are described as an alternative to the use of hexavalent chromium compound-containing solutions for the acidic post-treatment of phosphatized and or conversion coated metal surfaces. The solutions of these patents may also be employed on uncoated metal surfaces as an alternative to phosphating or other conversion coatings with the object of improving the corrosion resistance and paint adhesion characteristics of the metal surface.

U.S. Pat. No. 4,647,316 describes a hexavalent chromium protective conversion coating composition also comprising silica or silicates or mixtures thereof and phosphate and a process for coating metal surfaces therewith. There is nothing in the disclosure of this patent which would tend to suggest or otherwise provide motivation for applying a pretreatment solution of the type described herein to the metal surface before applying the protective conversion coating.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the exact numerical limits stated is generally preferred.

SUMMARY OF THE INVENTION

It is an objective of this invention to provide a protective conversion coating on a metal surface, and particularly on a continuous cast aluminum surface, wherein such coating has both a higher coating weight than conversion coatings currently in use and an adhesion to paint similar to the adhesion of the currently used protective conversion coatings.

It has been surprisingly found that the above objective is accomplished by a process in which a pretreatment composition is applied to the metal surface before application of a protective conversion coating to that surface. The conversion coating may be applied to the surface by a method that is conventional per se.

The pretreatment composition of the invention is an aqueous solution comprising, preferably consisting essentially of, and more preferably consisting of, at least one material selected from the group consisting of (i) a source of dissolved fluotitanate ions, (ii) a source of dissolved fluosilicate ions, and (iii) soluble or dispersible poly{alkenylphenols} and/or derivatives thereof, in an amount effective to substantially coat the metal surface.

Preferably, the pretreatment solutions according to the invention contain poly{alkenylphenols} and/or derivatives thereof, and more preferably contain both such organic polymers and fluotitanate and/or fluosilicate ions. The inorganic ions are preferably present in the form of the corresponding acids, inasmuch as the pretreatment solutions according to the invention are normally preferably acidic, but any water soluble source of the noted inorganic ions may be satisfactorily used.

Poly{alkenylphenols} or derivatives thereof useful in the practice of this invention are selected from the group consisting of polymers having the following general formula (I), acid salts thereof and mixtures thereof:

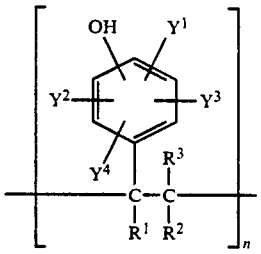

(I)n wherein, independently for each unit in the material:

each of $R^1$ through $R^3$ independently is hydrogen or an alkyl group having from 1 to about 5 carbon atoms;

each of $Y^1$ through $Y^4$ independently is hydrogen, Z, $CR^4R^5OR^6$, $CH_2Cl$, or an alkyl or aryl group having from 1 to 18 carbon atoms, where Z conforms to the general formula (II):

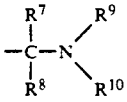

(II)

and each of $R^4$ through $R^{10}$ independently is hydrogen, or an alkyl, aryl, hydroxy-alkyl, amino-alkyl, mercapto-alkyl or phospho-alkyl moiety, said $R^4$ through $R^{10}$ being of carbon chain lengths up to a length at which the compound is not soluble or dispersible; and n is an integer having a value from 2 up to a number at which the polymer is not soluble or dispersible.

It should be appreciated that the pretreatment composition may comprise a polymer having a plurality of monomer units of the above general formula. For example, the polymer may conform to the following general formula (III):

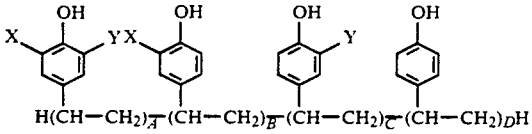

(III)

where X and Y are as defined below and each of A, B, C, and D independently is an integer in the range from 0 to up to but not including a number at which the polymer is water insoluble under the conditions of use. The sum A+B+C+D must be at least 2 and the total amount of the Z moieties, as defined above, must be sufficient that when neutralized with an acid, the polymer is water soluble or water dispersible. The particular amount as a molar percent needed for water solubility or dispersibility depends upon the molecular weight of the polymers as well as the particular $R^1$ through $R^{10}$ moieties in the polymer. Generally speaking, the molar percent of amino group or Z per phenolic group may vary from 10% to 200% and is usually 50% to 150%, there being one phenolic group per monomer unit.

Description of Preferred Embodiments

The pretreatment solution is preferably a stable aqueous solution comprising a water soluble or water dispersible poly{4-vinylphenol} derivative or an acid salt of a poly{4-vinylphenol} derivative. The preferred poly{4vinyl phenol} derivatives are selected from the group consisting of polymers having the following general formula (IV), acid salts thereof, and mixtures thereof:

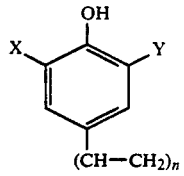

(IV)

wherein, independently for each unit in the material:

X represents H or Z;

Y represents H, Z, $CR^5R^6OR^6$, or $CH_2Cl$; and the other symbols have the same meaning as given above, the Z moieties being present in sufficient total amount that the compound is water dispersible.

A particularly preferred pretreatment composition is a stable aqueous composition comprising an effective amount of a water soluble and/or water dispersible polymer of 3-{N-methyl-N-(2-hydroxyethyl)amino} methyl-4-hydroxystyrene.

The hexavalent chromium protective conversion coating composition referred to above comprises (i) a hexavalent chromium-containing component, (ii) a component selected from the group consisting of silica and silicates and mixtures thereof, and, optionally but preferably, (iii) a trivalent chromium compound, and, optionally, (iv) a phosphate component. In a particularly preferred form, the protective conversion coating composition comprises a hexavalent chromium component in a weight ratio of hexavalent chromium to total chromium from about 0.5:1.0 to 1.0:1.0; a component selected from the group consisting of silica and silicates and mixtures thereof in a weight ratio to total chromium of from about 1.0:1.0 to about 3.0:1; and a phosphate component, if present at all, in a weight ratio of total chromium of from about 0.1:1.0 to 1.0:1.0.

The metal surface to be coated in accordance with this invention is preferably aluminum to which a reactive, water based primer coat is subsequently applied.

The process of the invention results in improved paint adhesion at higher than normal coating weights of the protective conversion coating, i.e., at coating weights of at least 86 mg/m$^2$, which is especially desirable on continuous cast aluminum.

In a typical metal treatment operation employing the process of this invention, the metal to be treated is initially cleaned by a chemical or physical process and water rinsed to remove grease and dirt from the surface. A particularly suitable cleaning composition for this purpose is an alkaline cleaner sold under the trademark PARCO TM Cleaner 305 by Parker-Amchem Division of Henkel Corporation. The cleaned metal surface is then treated with the pretreatment composition of this invention.

The present invention is useful with a broad range of metal surfaces. Examples of suitable metal surfaces include zinc and zinc alloys that are predominantly zinc, zinc and zinc alloy coated steel, iron, and cold-rolled, ground, pickled, and hot-rolled steel surfaces. Particularly suitable metal surfaces are aluminum, more particularly in the form of continuous cast aluminum.

In accordance with a process of the invention, a metal surface is treated with a solution comprising a pretreatment composition of the present invention.

It will, of course, be appreciated that the pretreatment composition of the present invention is preferably based on derivatives of poly{4-vinylphenol} polymer. Suitable derivatives having the above noted preferred general formula (IV) can be made, for example, by the Mannich Reaction. For example, a poly{4-vinylphenol} polymer can be reacted with formaldehyde and a secondary amine to yield a product which can be neutralized with an organic or inorganic acid to yield a water soluble or dispersible solution or emulsion suitable for use in a pretreatment composition in accordance with this invention. Further details regarding the preparation of suitable polymer components for the pretreatment composition are set forth in the above-mentioned U.S. Pat. Nos. 4,433,015, 4,457,790, 4,517,028, and 4,963,596, the entire disclosures of which, to the extent not inconsistent with any explicit statement herein, are hereby incorporated by reference herein.

The molecular weight of the poly{4-vinylphenol} incorporated in the pretreatment composition used in the process of the invention may range from the dimer, through more usually low molecular weight oligomers of 360, to high molecular weight polymers of 30,000 or greater. The upper limit of molecular weight is determined by the functional limitation that the derivative in question is water soluble or water dispersible.

The resulting derivatives of the formula set forth hereinabove will typically have a molecular weight of up to about 200,000, with molecular weights within the range of about 700 to about 70,000 being preferred. In the formula given for these derivatives, a typical upper value for "n" is up to about 850, with values of from about 10 to 300 being preferred. Similarly, the carbon chain lengths of the $R^1$ through $R^{10}$ substituents will typically be from about 1 to 18, with carbon chain lengths of from about 1 to 12 being preferred. It will, of course, be appreciated, that in each instance, a value for "n" and for the carbon lengths, as well as the percent of the "Z" moiety, will be selected which will provide the desired amount of water solubility and/or dispersibility.

The polymer component of the pretreatment composition is soluble in various organic solvents and may be used as a pretreatment solution dissolved in an organic solvent such as, ethanol. As a practical matter, however, it will be desired to apply the treatment compound from a water solution. To provide the desired water solubility or water dispersibility of the compound, an organic or inorganic acid may be used for neutralization of the amine moiety thereof. Useful acids for this purpose are acetic acid, citric acid, oxalic acid, ascorbic acid, phenylphosphonic acid, chloromethylphosphonic acid; mono-, di- and tri-chloroacetic acid, trifluoroacetic acid, nitric acid, phosphoric acid, hydrofluoric acid, sulfuric acid, boric acid, hydrochloric acid, hexaflurosilicic acid, hexafluorotitanic acid, hexafluorozirconic acid, and the like; alone or in combination with each other. Preferably a fluoride-containing acid selected from the group consisting of $H_2TiF_6$, $H_2ZrF_6$, $H2SiF_6$, HF, $HBF_4$ or a mixture of any two or more of such acids is used for neutralizing the polymer component of the pretreatment composition. Particularly good results have been obtained using $H_2TiF_6$. The addition of water to the neutralized, over-neutralized or partially neutralized polymer component mentioned above results in a water soluble or dispersible solution or emulsion of the polymer useful for metal treatment.

The pH of the solution may vary from pH 0.5 to 12, but for practical purposes is usually kept between 1.0 and 8.0, both for the stability of the solution and for best results on the treated metal surface.

It is contemplated that the polymer component of the pretreatment composition used in the practice of the invention will be at a relatively dilute concentration of, for example, from about 0.01% to about 5% by weight. Practically speaking, a concentration of 0.1% to 1% of the polymer component in the working solution is preferred. However, under some circumstances, for example, for transporting or storing the solution, a concentrate of the pretreatment composition may be preferred. Thus, a solution comprising up to 30% of the polymer component might be prepared. From a commercial point of view, a preferable concentrate of this invention comprises from 1% to 30% of the polymer component.

Application of the treatment solution of the present invention in the treatment step to a metal surface may be carried out by any conventional method. For example, the pretreatment composition may be applied by spray coating, roller coating, or dipping. The temperature of the solution applied may vary over a wide range, but is preferably from 21° C. to 71° C. After application of the pretreatment composition to the metal surface, the surface may optionally be rinsed with water although better results can generally be obtained without rinsing.

Next, the treated metal surface is dried. Drying can be carried out by, for example, circulating air or infrared oven drying. While room temperature drying may be employed, it is usually preferable economically to use elevated temperatures to decrease the amount of drying time required.

The protective conversion coating composition to be used in the present invention comprises, preferably consists essentially of, or more preferably consists of, (i) a hexavalent chromium-containing component, (ii) a component selected from the group consisting of silica and silicates and mixtures thereof, and, optionally but preferably, (iii) a trivalent chromium-containing component, and, optionally, (iv) a phosphate component.

The phosphate and chromium-containing components of the present invention may be supplied in any form which does not interfere with the quality of the final conversion coating. Addition in the form of alkali metal salts should be minimized and preferably avoided since such salts may interfere with the quality of the coating. The phosphate and hexavalent chromium components are preferably added as relatively soluble di- or tri-valent metal salts, thermally stable ammonium or amine salts (including double salts with the foregoing metals), or in acid form. Suitable di- or tri-valent metal salts include salts of, for example, zinc, manganese, chromium, nickel, cobalt, and iron. The hexavalent chromium component is preferably added as zinc dichromate or chromic anhydride ($CrO_3$), and the phosphate component is preferably added as zinc dihydrogen phosphate or as phosphoric acid. Hexavalent chromium is advantageously employed herein in a weight ratio of from about 0.5:1.0 total chromium up to 1.0:1.0 total chromium and is preferably employed in a weight ratio of from about 0.52:1.0 total chromium up to 0.75:1.0 total chromium. Phosphate, if used, is preferably employed herein in a weight ratio to total chromium in the range from about 0.1:1 up to about 5.0:1, and more preferably from about 0.1:1 up to about 1.5:1.

The silica or silicate component of the protective conversion coating must be capable of dissolving in the aqueous composition or becoming dispersed therein to form a homogeneous dispersion, at least on the colloidal scale. It is therefore preferably used in a finely-divided form. The use of fume or precipitated silica is preferred, but ground naturally-occurring quartz and diatomaceous earth may also be used when the necessary dispersion can be obtained. There may also be used silicates such a montmorillonite or synthetic fluosilicates, such as complex magnesium fluosilicates sold under the trade name Laponite TM. The use of soluble sodium or potassium silicates and fluosilicates is much less preferred since they tend to form glassy coatings with poor adhesion and therefore the use of a water-insoluble silica or silicate that is nevertheless colloidally dispersible in the solution is preferred. Mixtures of different forms of silica and/or different silicates may be used if desired. The component selected from the group consisting of silica and silicates and mixtures thereof is employed herein in a weight ratio of from about 0.5:1 total chromium up to about 5.0:1 total chromium and preferably from about 1.0:1 total chromium up to about 3.0:1 total chromium.

The trivalent chromium compound can be prepared by the partial reduction of an aqueous solution of chromic acid with starch and heat in a conventional manner such as is disclosed, for example, in U.S. Pat. No. 3,706,603, of Dec. 10, 1972 to Vessey et al. The partially reduced solution will, of course, contain both hexavalent and trivalent chromium compounds.

In addition to the above components, additional components may be optionally included in the conversion coating composition used in the practice of this invention, e.g., di- and tri-valent metal cations such as zinc, manganese, cobalt, nickel, and iron; inert coloring agent designed to provide a specific color to the protective coating; silicon compounds; a conductive material to improve weldability, such as pulverulent metal as disclosed in U.S. Pat. No. 3,671,331; and emulsifying agents useful to maintain the resin component in a dispersed state (normally present in commercially available resin aqueous dispersions).

The protective conversion coating composition for use in the present invention may normally be used without any need for pH adjustment. Where the components are added in the form of di- and tri-valent metal salts or as the acids, pH values below 2.5 will normally be obtained. On the other hand, if the components are added as the ammonium or amine salts, less acidic pH values will be obtained.

The protective conversion coating composition may be prepared by mixing the essential ingredients in any order to provide the desired weight ratios. However, the silica or silicate component is preferably added after partial reduction of hexavalent chromium if heat is employed during the reduction, because heat may reduce the dispersible nature of the silica. Since no substantial reaction with the metal surface normally takes place prior to curing, the components of the liquid film deposited from the bath are initially present in the same concentration as in the bath. Therefore, the concentration of the essential components in a replenishing composition will usually be substantially the same as in the working composition. This fact simplifies bath control and improves product uniformity.

Depending on the method of application, a wide range of concentrations could be employed herein. A working solution can, for example, comprise from about 0.1% to about 12.0% total chromium and will usually preferably comprise from about 0.15% to about 8.0% total chromium.

The protective conversion coating process of the present invention is especially useful for application to aluminum, particularly in a continuously cast form, to provide improved corrosion protection and formability for painted stock. However, the composition may also be used over zinc and zinc alloy coated steel, cold-rolled steel, and surfaces of other ferrous metals and alloys thereof.

Application of the aqueous composition to the metal surface may be accomplished in any of the conventional manners so long as sufficient care is taken to obtain a reasonably uniform thickness of the aqueous film. For flat surfaces such as sheet or strip, this control may be accomplished most readily through the use of rollers, or squeegees. However, the composition may be applied by any suitable conventional method such as mist-on techniques.

Coating weights may vary from as little as 0.01 to as much as 4 $g/m^2$ or higher. Normally, the coating weight for continuous cast aluminum surfaces will be at least 0.07 $g/m^2$ Coating weights for aluminum surfaces will most preferably be between 0.11 $g/m^2$ and 0.13 $g/m^2$ while for ferrous surfaces the coating weight will typically be between about 0.16 $g/m^2$ and about 0.54 $g/m^2$ and for zinc and zinc alloy surfaces between about 0.11 $g/m^2$ and about 0.21 $g/m^2$.

In operation, processing variables will normally be determined based upon the desired coating weight to be obtained. A film of predetermined thickness of the protective conversion coating composition, with the thickness depending upon the overall concentration of the components in the working composition, will be applied to the metal surface from a working bath and then cured by heating. As the surface is cured, the composition becomes concentrated and a reaction will begin to take place between the components of the composition and the metal surface to form the protective conversion coating. Normal ambient temperatures are suitable for the working bath. However, the working bath and/or the metal surface may be preheated in order to hasten the curing process.

Metal temperatures of up to about 93° C or higher may be employed for immersion or roll-on applications without degrading the bath. Higher temperatures may be employed in connection with mist-on application. The manner of curing is not critical so long as the liquid film is not unduly disrupted, e.g., by strong hot air currents or physical contact during the curing process. However, the manner of curing may affect the curing temperature. For example, curing is obtained at lower peak metal temperatures in an infrared oven than in a conventional oven. Under normal operations, it is desirable to use elevated oven temperatures and warm air streams of velocity insufficient to disturb the wet film. From a practical standpoint, the oven temperature should result in a metal temperature of between about 52° and 163° C.

Finally, the cured surface is normally painted, e.g., with a reactive water-based primer followed by a top coat. The paint may be applied to the coated metal surface by any conventional means.

Further appreciation of the present invention may be had from the following examples which are intended to illustrate, but not limit, the invention.

EXAMPLE 1

This example describes the preparation of a composition suitable for use in the invention. An amount of 45 kilograms (hereinafter "kg") of ethylene glycol monopropyl ether was charged into a stainless steel reactor, with a capacity of about 378 liters, containing a turbine blade, nitrogen sparge, and condenser. Gentle heating to 50° C. was started, and 36 kg of poly{4-vinylphenol} polymer of an average molecular weight of about 5000 was slowly added to the ether solvent with good stirring. After all of the polymer was added, the reactor was closed and heated to 80° C. to aid in dissolving the remaining polymer. The reactor was then cooled to 40° C., and 23 kg of N-methylaminoethanol and 45 kg of deionized water were added. Then over one (1) hour 24.6 kg of 37% aqueous formaldehyde solution was added while maintaining the temperature at 40±2° C. The reactor was then heated for 3 hours at 40° C., and 143 kg of aqueous 60% fluotitanic acid ($H_2TiF_6$) was added. The total reaction mixture was then diluted to 20% solids with deionized water to yield a stable solution of an aqueous pretreatment composition for use in carrying out the method of the present invention.

EXAMPLES AND COMPARISON EXAMPLES 2-14

A group of 10×30 centimeter aluminum test panels (numbered 2-14) were cleaned with a strong alkaline cleaner (PARCO TM 305, a product of Parker-Amchem Division of Henkel Corp.) by spray application at 52° F. solution temperature for 20 seconds. This cleaning step was followed by a hot water rinse. To each of the cleaned panels was applied a different one of the aqueous pretreatment solutions listed in Table 1 below. The pretreatment solutions were applied to the panels by spray and squeegee.

TABLE 1

| Test Panel No. | Pretreatment Composition Type | pH | Conversion Coating Weight g/m² | T-bends 1T | 2T | Crazing on 2T | Cold Impact | Room Temp. Impact |
|---|---|---|---|---|---|---|---|---|
| 2 | Note 1 | 5.1 | 0.108 | 3 | 9 | 6 | 10 | 10 |
| 3 | Note 2 | 2.4 | 0.111 | 5 | 9.5 | 7 | 10 | 10 |
| 4 | Note 3 | 2.3 | 0.067 | 5 | 10 | 7 | 10 | 10 |
| 5 | Note 3 | 2.3 | 0.111 | 3 | 8 | 3 | 10 | 10 |
| 6 | None | — | 0.111 | 0 | 5 | 3 | 10 | 10 |
| 7 | HF[4] | 2.5 | 0.111 | 0 | 7 | 3 | 10 | 10 |
| 8 | $H_2TiF_6$[4] | 2.5 | 0.111 | 3 | 9 | 7 | 10 | 10 |
| 9 | $H_2ZrF_6$[4] | 2.4 | 0.111 | 0 | 7 | 3 | 10 | 10 |
| 10 | $H_2SiF_6$[4] | 2.4 | 0.111 | 3 | 9 | 7 | 10 | 10 |
| 11 | $HBF_4$[4] | 2.4 | 0.111 | 0 | 5 | 3 | 10 | 10 |
| 12 | $HNO_3$[4] | 2.5 | 0.111 | 0 | 7 | 3 | 10 | 10 |
| 13 | $H_2SO_4$[4] | 2.5 | 0.111 | 3 | 5 | 3 | 10 | 10 |
| 14 | $H_3PO_4$[4] | 2.5 | 0.114 | 0 | 8 | 3 | 10 | 10 |

Notes for Table 1

1. This pretreatment composition was made according to the procedure described in Example 2 of U.S. Pat. No. 4,433,015.
2. This pretreatment was that made in Example 1 above.
3. This was a conventional, commercially available pretreatment solution, PARCOLENE TM 71 (available from Parker + Amchem Div. of Henkel Corp., Madison Heights, Michigan), which contains a mixture of inorganic acids but does not contain fluotitanic or fluosilicic acid.
4. These pretreatment solutions were aqueous solutions of the noted acids in sufficient quantity to produce the pH values shown.

After the pretreatment solutions had dried on the test panels, the treated panels were treated with BONDERITE TM 1415A, a commercial conventional chormating composition containing hexavalent and trivalent chromium, phosphate, and silica, to form a protective conversion coating on the panels. Each panel was then dried in an infra red oven to 71° C. peak metal temperature. Each panel was then painted with a water based primer (1PLY 4920, a product of PPG Corp.). The painted panels were cured in a forced air oven for 10 seconds at 216° C., equivalent to 121° C. peak metal temperature. Then the dried and cured primed panels were coated with a conventional top coat (1LW 40842. a product of PPG Corp.) and cured in a forced air oven at 260° C. air temperature for 22 seconds to obtain a peak metal temperature of 216° C.

The panels were measured for the coating weight of the conversion coating in milligrams per square meter of test panel surface. Then the panels were subjected to T-Bend tests and evaluated at 1T, 2T and crazing on 2T. The T-Bend testing method is described in "Standard Practice for Testing Coil Coatings" D 3794, *Annual Book of ASTM Standards,* American Society for Testing and Materials. T-Bend testing is a way of measuring the adhesion of the protective conversion coating to the subsequently applied paint under conditions analogous to metal forming.

Next, all of the test panels were subjected to a cold impact test and a room temperature impact test. The impact test used is described in "Standard Test Method for Resistance of Organic Coatings to the Effects of Rapid Deformation (Impact)" D2794, *Annual Book of ASTM Standards,* American Society for Testing Materials. The contents of both of these ASTM test procedures are specifically incorporated herein by reference. After each of the T-Bend and Impact tests, the panels were rated between 0 and i0 with "10" representing no removal of paint and a "0" representing complete paint removal. In a like manner, ratings on "2T crazing" were rated from 0 to 10 with "10" representing no crazing and "0" representing 100% crazing. The results obtained from these ratings for each of the panels 2-14 are given in Table 1.

As shown in Table 1, all of the panels tested had satisfactory impact results. The aluminum panels numbered 2, 3, 8, and 10 that were treated with an aqueous pretreatment composition according to this invention achieved substantially better T-Bend test results than any of the other panels tested, except for the one (panel 4) of the two panels treated with the conventional pretreatment solution that had substantially lower coating weight (i.e., 0.067 g/m² vs. 0.111 g/m²). As already noted above, such low coating weights are known to lead to lowered corrosion resistance in practical service and in other types of laboratory corrosion testing that are not shown here. A higher treatment weight with the same conventional pretreatment composition, as exemplified by panel No. 5 in Table 1, results in substantially lower adhesion as indicated by the inferior T-bend test results in the Table.

The best results with a composition according to the invention were with an aqueous pretreatment composition of the invention produced according to Example 1 above (panel 3 in the Table), containing both a poly{4-vinylphenol} and fluotitanate ions. The other three panels treated with a pretreatment composition according to the invention, i.e., panels number 2, 8, and 10, produced T-Bend results superior to all of the non-invention pretreatment compositions, except the low weight conventional treatment as already noted. The pretreatment solutions used for panel 2 had a poly{4-vinylphenol polymer}, but no fluotitanic or fluosilicic acid, while the solutions for panels number 8 and 10 contained the preferred acids but not the polymer. These results evidence the clear advantage to be gained by treating metal surfaces according to the process of the invention.

Examples and Comparison Examples 15.1–17.3

These examples illustrate the effect of varying both the pretreatment and the conversion coating treatment. The test panels used were of Type 3105 aluminum alloy. The general procedure used was the same as for Examples and Comparison Examples 2–14, except that only the 1T and 2T T-bend tests were performed, and the pretreatment and conversion coating treatments were as follows:

Comparison Experiment 15: no pretreatment

Comparison Experiment 16: PARCOLENE TM 71

Experiment 17: Composition as made in Example 1 above.

Conversion Coating x.1: BONDERITE TM 1415A as described above.

Conversion Coating x.2: BONDERITE TM 1402W, with the same ingredients as noted above for BONDERITE TM 1415A, but in different proportions.

Conversion Coating x.3: A composition having the same ingredients as items x.1 and x.2, except that it contains no phosphate.

(All BONDERITE TM products are available commercially from the Parker+Amchem Division of Henkel Corp., Madison Heights, Mich.)

The results from these experiments and comparison experiments are shown in Table 2.

TABLE 2

T-BEND TEST RESULTS FOR COMPARISON EXAMPLES 15-16 AND EXAMPLE 17

| Test No.: | 15.1 | 15.2 | 15.3 | 16.1 | 16.2 | 16.3 | 17.1 | 17.2 | 17.3 |
|---|---|---|---|---|---|---|---|---|---|
| 1T Rating: | 0 | 5 | 6 | 3 | 7 | 6 | 5 | 8.5 | 8 |
| 2T Rating: | 5 | 9.5 | 9.5 | 8 | 9.5 | 9.5 | 9.5 | 10 | 10 |

Note for Table 2

The pretreatment coating weight was 0.11 g/m$^2$ for each of Comparison Experiment 16 and Experiment 17, and the conversion coating weight was 0.11 g/m$^2$ for all panels.

While it will be apparent that the preferred embodiments of the invention disclosed are well calculated to fulfill the objects above stated, it will be appreciated that the invention is susceptible to modifications, variations and change without departing from the proper scope or fair meaning of the following claims.

What is claimed is:

1. A process for improving the adhesion of a protective conversion coating on a metal surface, said process comprising:

(A) applying to said metal surface an aqueous pretreatment composition comprising at least one material selected from the group consisting of (i) sources of dissolved fluotitanate ions, (ii) sources of dissolved fluosilicate ions, and (iii) dissolved or dispersed polymer in an amount effective to coat said metal surface, said dissolved or dispersed polymer being selected from the group consisting of polymers having the following general formula I, acid salts thereof and mixtures thereof:

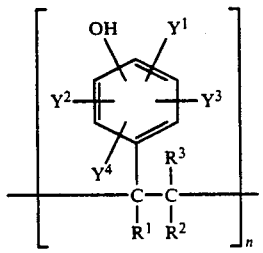

(I)n wherein, independently for each unit in the material:

each of $R^1$ through $R^3$ independently is hydrogen or an alkyl group having from 1 to about 5 carbon atoms;

each of $Y^1$ through $Y^4$ independently is hydrogen, Z, $CR^4R^5OR^6$, $CH_2Cl$, or an alkyl or aryl group having from 1 to 18 carbon atoms, where Z conforms to the general formula (II):

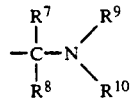

(II)

and each of $R^4$ through $R^{10}$ independently is hydrogen, or an alkyl, aryl, hydroxy-alkyl, amino-alkyl, mercapto-alkyl or phospho-alkyl moiety, said $R^4$ through $R^{10}$ being of carbon chain lengths up to a length at which the compound is not soluble or dispersible; and n is an integer having a value from 2 up to a number at which the polymer is not soluble or dispersible (B) drying the metal surface to which the pretreatment composition was applied in step (A); and (C) applying to the metal surface dried from step (B) a protective conversion coating composition, comprising (i) a hexavalent chromium-containing component, (ii) a component selected from the group consisting of silica and silicates and mixtures thereof, and, optionally, (iii) a phosphate component and, optionally, (iv) a trivalent chromium-containing component, the amount of said protective conversion coating composition applied being effective to produce a protective conversion coating weight of at least 0.075 g/m$^2$ on said metal surface.

2. A process according to claim 1, wherein there is no intermediate rinse with water between steps (A) and (B).

3. A process according to claim 1, wherein dissolved or dispersed polymer is used in step (A) and is selected from molecules conforming to formula IV:

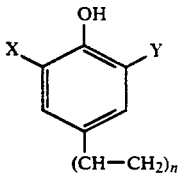

(IV)

wherein, independently for each unit in the material:

X represents H or Z;

Y represents H, Z, $CR^5R^6OR^7$, or $CH_2Cl$; and the other symbols have the same meaning as given in claim 1, said polymer being at least partially acid neutralized.

4. A process as claimed in claim 3 in which the aqueous pretreatment composition applied to said metal surface comprises dissolved or dispersed polymer in an amount of from about 0.01% to about 5% by weight.

5. A process as claimed in claim 3 wherein the polymer is acid neutralized with an acid selected from the group consisting of $H_2TiF_6$, $H_2SiF_6$, $H_2ZrF_6$, $H_2BF_4$, HF, and mixtures thereof.

6. A process as claimed in claim 3 in which the pH of said pretreatment composition is within the range of from about 1.0 to about 8.0.

7. A process as claimed in claim 3 in which the aqueous pretreatment composition in step (A) comprises dissolved or dispersed polymer in an amount of from about 0.1% to about 1% by weight.

8. A process as claimed in claim 3 in which the protective conversion coating is applied to said metal surface at a coating weight of at least about 0.11 $g/m^2$.

9. A process according to claim 8, wherein the protective conversion coating is applied by covering the pretreated and dried metal surface with a layer of a protective conversion coating composition comprising (i) the hexavalent chromium component in a weight ratio of hexavalent chromium to total chromium from about 0.5:1.0 to 1.0:1.0, (ii) the component selected from the group consisting of silica, silicates, and mixtures thereof in a weight ratio to total chromium of from about 1.0:1.0 to about 3.0:1.0, and (iii) the phosphate component, if present, in a weight ratio to total chromium not greater than about 1.0:1.0.

10. A process as claimed in claim 9 in which the aqueous pretreatment composition used in step (A) comprises dissolved or dispersed polymer in an amount of about 0.01% to about 5% by weight.

11. A process as claimed in claim 10 wherein the polymer is acid neutralized with an acid selected from the group consisting of $H_2TiF_6$, $H_2SiF_6$, $H_2ZrF_6$, $H_2BF_4$, HF, and mixtures thereof.

12. A process as claimed in claim 10 in which the pH of the pretreatment composition is within the range of from about 1.0 to about 8.0.

13. A process as claimed in claim 12 in which the aqueous pretreatment composition applied to said metal surface comprises said water dissolved or dispersed polymer in an amount of from about 0.1% to about 1% by weight.

14. A process as claimed in claim 10 in which the protective conversion coating is applied to the pretreated and dried metal surface at a coating weight of at least about 0.11 $g/m^2$.

15. A process for improving the adhesion of a protective conversion coating on a cleaned aluminum surface, said process comprising:

(A) applying to said aluminum surface a stable aqueous pretreatment composition comprising a polymer of 3-{N-methyl-N-(2-hydroxyethyl)aminomethyl}-4-hydroxystyrene}, at least partially neutralized with $H_2TiF_6$, in an amount sufficient to coat said aluminum surface;

(B) drying the aluminum surface to which the pretreatment composition was applied in step (A); and (C) applying to the metal surface from the end of step (B) a protective conversion coating composition comprising (i) a hexavalent chromium-containing component, (ii) a component selected from the group consisting of silica, silicates, and mixtures thereof, (iii) a trivalent chromium-containing component, and, optionally, (iv) a phosphate component, in an amount effective to produce a coating weight of the protective conversion coating of at least 0.11 $g/m^2$ on the aluminum surface.

16. A process according to claim 15, wherein there is no intermediate rinse with water between steps (A) and (B).

17. A process as claimed in claim 16 in which the aqueous pretreatment composition contains from about 0.01% to about 5% by weight of the polymer of 3-{N-methyl-N-(2-hydroxyethyl)aminomethyl}-4-hydroxystyrene.

18. A process as claimed in claim 16 in which the step of applying the protective conversion coating composition to the aluminum surface is followed by drying and curing the protective conversion coating composition and thereafter applying a water based primer to the metal surface bearing the protective conversion coating.

19. A process for improving the adhesion of a protective conversion coating on a continuous cast aluminum surface, said process comprising:

(A) cleaning said aluminum surface with an alkaline cleaning solution;

(B) applying to the cleaned aluminum surface a stable aqueous pretreatment composition comprising $H_2TiF_6$-neutralized polymer of 3-{N-methyl-N-(2-hydroxyethyl)aminomethyl}-4-hydroxystyrene, in an amount sufficient to coat the cleaned aluminum surface;

(C) drying said pretreatment composition onto the aluminum surface;

(D) applying to the aluminum surface bearing the dried pretreatment composition a protective conversion coating composition comprising hexavalent and trivalent chromium, water soluble or dispersible silica, and, optionally, phosphate ions, with water making up the balance of the composition, the composition being applied in an amount effective to produce a coating mass of the protective conversion coating per unit area of at least 0.11 $g/m^2$ on the aluminum surface;

(E) drying and curing said protective conversion coating composition into place on the conversion coated surface; and (F) applying a water based primer to the surface from the end of step (E).

20. A process as claimed in claim 19 in which the aqueous pretreatment composition contains from about 0.01% to about 5% by weight of the polymer of poly 3-{N-methyl-N-(2-hydroxyethyl)aminomethyl}-4-hydroxystyrene.

* * * * *